US010606197B2

(12) United States Patent
Okuno

(10) Patent No.: US 10,606,197 B2
(45) Date of Patent: Mar. 31, 2020

(54) ENDLESS BELT, FIXING DEVICE, IMAGE FORMING APPARATUS, AND METHOD OF MANUFACTURING ENDLESS BELT

(71) Applicant: Konica Minolta Inc., Tokyo (JP)

(72) Inventor: Akihiro Okuno, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/170,908

(22) Filed: Oct. 25, 2018

(65) Prior Publication Data

US 2019/0137914 A1 May 9, 2019

(30) Foreign Application Priority Data

Nov. 7, 2017 (JP) ..... 2017-214783

(51) Int. Cl.
*G03G 15/20* (2006.01)

(52) U.S. Cl.
CPC . *G03G 15/2057* (2013.01); *G03G 2215/2048* (2013.01)

(58) Field of Classification Search
CPC ..... G03G 15/2057; G03G 2215/0016
See application file for complete search history.

(56) References Cited

U.S. PATENT DOCUMENTS 9,235,135 B2 * 1/2016 Kanao ..... G03F 9/7003
2009/0128615 A1 * 5/2009 Miller ..... B41M 5/26 347/232
2016/0378036 A1 * 12/2016 Onishi ..... G03G 15/5054 399/302

FOREIGN PATENT DOCUMENTS

JP 02271375 A * 11/1990
JP 2005-338350 A 12/2005
JP 2008-225066 A 9/2008
JP 2016-161929 A 9/2016
JP 2017-111242 A 6/2017

* cited by examiner

*Primary Examiner* — Erika J Villaluna
(74) *Attorney, Agent, or Firm* — Lucas & Mercanti, LLP

(57) ABSTRACT

An endless belt includes a base layer having an endless belt shape, an elastic layer provided on the base layer, and a surface layer provided on the elastic layer. The surface layer contains fluororesin. The surface layer is provided with at least one mark portion formed through alteration of the surface layer by spot irradiation with laser light having an ultraviolet-region wavelength.

15 Claims, 8 Drawing Sheets

FIG.8

<FIRST VERIFICATION EXPERIMENT>

| SYSTEM | LASER TYPE | WAVELENGTH (nm) | TYPE | IRRADIATION OF FRONT LAYER | | |
|---|---|---|---|---|---|---|
| | | | | RELATIONSHIP BETWEEN PULSE INTERVAL pt AND LASER SPOT DIAMETER d | DETERMINATION OF FRONT SURFACE FLOATING (DETERMINED VISUALLY) | REFLECTANCE DIFFERENCE (20% OR MORE) |
| LASER MARKER | ULTRAVIOLET LASER | 266 | SOLID LASER | pt<d | GOOD | FAIR |
| | | | | pt=d | GOOD | GOOD |
| | | | | 2d>pt>d | GOOD | GOOD |
| | | | | pt=2d | GOOD | GOOD |
| | | | | pt>2d | FAIR | GOOD |
| | | 355 | SOLID LASER | pt<d | GOOD | FAIR |
| | | | | pt=d | GOOD | GOOD |
| | | | | 2d>pt>d | GOOD | GOOD |
| | | | | pt=2d | GOOD | GOOD |
| | | | | pt>2d | FAIR | GOOD |
| | VISIBLE-LIGHT LASER | 532 | SOLID LASER | pt<d | GOOD | POOR |
| | | | | pt=d | POOR | FAIR |
| | | | | 2d>pt>d | POOR | GOOD |
| | | | | pt=2d | POOR | GOOD |
| | | | | pt>2d | POOR | GOOD |
| | INFRARED LASER | 1,064 | SOLID LASER | pt<d | GOOD | POOR |
| | | | | pt=d | POOR | FAIR |
| | | | | 2d>pt>d | POOR | GOOD |
| | | | | pt=2d | POOR | GOOD |
| | | | | pt>2d | POOR | GOOD |
| | | 9,300 | $CO_2$ LASER | pt<d | POOR | POOR |
| | | | | pt=d | POOR | FAIR |
| | | | | 2d>pt>d | POOR | GOOD |
| | | | | pt=2d | POOR | GOOD |
| | | | | pt>2d | POOR | GOOD |
| | | 10,600 | $CO_2$ LASER | pt<d | POOR | POOR |
| | | | | pt=d | POOR | POOR |
| | | | | 2d>pt>d | POOR | FAIR |
| | | | | pt=2d | POOR | GOOD |
| | | | | pt>2d | POOR | GOOD |

FIG.9

<SECOND VERIFICATION EXPERIMENT>

| LASER TYPE | WAVELENGTH (nm) | TYPE | IRRADIATION OF FRONT LAYER | | | |
|---|---|---|---|---|---|---|
| | | | RELATIONSHIP BETWEEN PULSE INTERVAL pt AND LASER SPOT DIAMETER d | PULSE ENERGY | DETERMINATION OF FRONT SURFACE FLOATING (DETERMINED VISUALLY) | REFLECTANCE DIFFERENCE (20% OR MORE) |
| ULTRAVIOLET LASER | 266 | SOLID LASER | pt<d | LESS THAN 0.01 mJ | GOOD | POOR |
| | | | | 0.01 mJ OR MORE AND 0.2 mJ OR LESS | GOOD | FAIR |
| | | | | MORE THAN 0.2 mJ | FAIR | GOOD |
| | | | pt=d | LESS THAN 0.01 mJ | GOOD | GOOD |
| | | | | 0.01 mJ OR MORE AND 0.2 mJ OR LESS | GOOD | GOOD |
| | | | | MORE THAN 0.2 mJ | GOOD | GOOD |
| | | | 2d>pt>d | LESS THAN 0.01 mJ | GOOD | GOOD |
| | | | | 0.01 mJ OR MORE AND 0.2 mJ OR LESS | GOOD | GOOD |
| | | | | MORE THAN 0.2 mJ | GOOD | GOOD |
| | | | pt=2d | LESS THAN 0.01 mJ | GOOD | GOOD |
| | | | | 0.01 mJ OR MORE AND 0.2 mJ OR LESS | GOOD | GOOD |
| | | | | MORE THAN 0.2 mJ | GOOD | GOOD |
| | | | pt>2d | LESS THAN 0.01 mJ | FAIR | GOOD |
| | | | | 0.01 mJ OR MORE AND 0.2 mJ OR LESS | FAIR | GOOD |
| | | | | MORE THAN 0.2 mJ | FAIR | GOOD |
| | 355 | SOLID LASER | pt<d | LESS THAN 0.01 mJ | GOOD | POOR |
| | | | | 0.01 mJ OR MORE AND 0.2 mJ OR LESS | GOOD | FAIR |
| | | | | MORE THAN 0.2 mJ | GOOD | FAIR |
| | | | pt=d | LESS THAN 0.01 mJ | GOOD | GOOD |
| | | | | 0.01 mJ OR MORE AND 0.2 mJ OR LESS | GOOD | GOOD |
| | | | | MORE THAN 0.2 mJ | GOOD | GOOD |
| | | | 2d>pt>d | LESS THAN 0.01 mJ | GOOD | GOOD |
| | | | | 0.01 mJ OR MORE AND 0.2 mJ OR LESS | GOOD | GOOD |
| | | | | MORE THAN 0.2 mJ | GOOD | GOOD |
| | | | pt=2d | LESS THAN 0.01 mJ | GOOD | GOOD |
| | | | | 0.01 mJ OR MORE AND 0.2 mJ OR LESS | GOOD | GOOD |
| | | | | MORE THAN 0.2 mJ | GOOD | GOOD |
| | | | pt>2d | LESS THAN 0.01 mJ | FAIR | GOOD |
| | | | | 0.01 mJ OR MORE AND 0.2 mJ OR LESS | FAIR | GOOD |
| | | | | MORE THAN 0.2 mJ | POOR | GOOD |

FIG.10

<THIRD VERIFICATION EXPERIMENT>

| SYSTEM | LASER TYPE | WAVELENGTH (nm) | TYPE | IRRADIATION OF FRONT LAYER | |
|---|---|---|---|---|---|
| | | | | MARK AREA [mm^2] | DETERMINATION OF FRONT SURFACE FLOATING (DETERMINED VISUALLY) |
| LASER MARKER | ULTRAVIOLET LASER | 266 | SOLID LASER | 1 | GOOD |
| | | | | 5 | GOOD |
| | | | | 10 | GOOD |
| | | | | 25 | GOOD |
| | | | | 30 | GOOD |
| | | 355 | SOLID LASER | 1 | GOOD |
| | | | | 5 | GOOD |
| | | | | 10 | GOOD |
| | | | | 25 | GOOD |
| | | | | 30 | GOOD |
| | VISIBLE-LIGHT LASER | 532 | SOLID LASER | 1 | GOOD |
| | | | | 5 | GOOD |
| | | | | 10 | GOOD |
| | | | | 25 | GOOD |
| | | | | 30 | POOR |
| | INFRARED LASER | 1,064 | SOLID LASER | 1 | GOOD |
| | | | | 5 | GOOD |
| | | | | 10 | GOOD |
| | | | | 25 | POOR |
| | | | | 30 | POOR |
| | | 9,300 | $CO_2$ LASER | 1 | GOOD |
| | | | | 5 | GOOD |
| | | | | 10 | GOOD |
| | | | | 25 | POOR |
| | | | | 30 | POOR |
| | | 10,600 | $CO_2$ LASER | 1 | GOOD |
| | | | | 5 | GOOD |
| | | | | 10 | GOOD |
| | | | | 25 | POOR |
| | | | | 30 | POOR |

ENDLESS BELT, FIXING DEVICE, IMAGE FORMING APPARATUS, AND METHOD OF MANUFACTURING ENDLESS BELT

Japanese Patent Application No. 2017-214783 filed on Nov. 7, 2017, including description, claims, drawings, and abstract the entire disclosure is incorporated herein by reference in its entirety.

BACKGROUND

The present invention relates to an endless belt for an image forming apparatus, a fixing device and an image forming apparatus each including the endless belt, and a method of manufacturing an endless belt for an image forming apparatus.

TECHNOLOGICAL FIELD

In a conventional endless belt such as a fixing belt for an image forming apparatus, a mark formed in the endless belt is detected by a sensor.

For example, in the image forming apparatus disclosed in Japanese Laid-Open Patent Publication No. 2008-225066, a fixing belt is formed of a base layer, a conductive layer, an elastic layer, and a surface layer stacked in order from the inner surface side, and a mark material is buried between the elastic layer and the surface layer. The speed of the fixing belt is calculated from a pulse interval obtained by detecting the mark material by the sensor and is then fed back to control of the fixing device.

Used as the mark material is a metal foil such as aluminum foil. In this case, the heat conductivity of the metal foil is higher than that of the elastic layer or the surface layer, leading to easy deterioration of the fixing belt around the mark material.

When a hole is made in the fixing belt and the hole is used as a mark, the tensile strength of the fixing belt decreases drastically around the hole, causing fear that the fixing belt may be cracked or broken.

Considering the above, a mark is formed in the fixing belt with a laser. Examples of the publication disclosing a fixing belt having a mark formed with a laser include Japanese Laid-Open Patent Publication No. 2005-338350, Japanese Laid-Open Patent Publication No. 2016-161929, and Japanese Laid-Open Patent Publication No. 2017-111242.

DESCRIPTION OF THE RELATED ART

In the fixing belts disclosed in Japanese Laid-Open Patent Publication No. 2005-338350 and Japanese Laid-Open Patent Publication No. 2016-161929, an elastic layer is irradiated with a laser to form a mark portion, and subsequently, the elastic layer and the mark portion are covered with a surface layer. This decreases the sharpness of the mark portion.

In the fixing belt disclosed in Japanese Laid-Open Patent Publication No. 2017-111242, a mark portion is formed in the surface layer. The surface layer is, however, irradiated with a laser having an infrared-region wavelength, which thermally damages an adhesive layer located between the surface layer and the elastic layer. This may cause a part of the surface layer irradiated with a laser to float from the elastic layer.

The present invention has been made in view of the above problems, and an object of the present invention is to provide an endless belt that can prevent or reduce floating of a surface layer from an elastic layer and includes a sharp mark portion, a fixing device and an image forming apparatus each including the endless belt, and a method of manufacturing the endless belt.

SUMMARY

To achieve at least one of the abovementioned objects, according to an aspect of the present invention, an endless belt for an image forming apparatus reflecting one aspect of the present invention comprises an endless base layer, an elastic layer provided on the base layer, and a surface layer provided on the elastic layer. The surface layer contains fluororesin. The surface layer is provided with at least one mark portion. The at least one mark portion is formed through alteration of a part of the surface layer by irradiation of the surface layer with laser light having an ultraviolet-region wavelength.

To achieve at least one of the abovementioned objects, according to an aspect of the present invention, a fixing device reflecting one aspect of the present invention comprises the endless belt, and a plurality of winding members around which the endless belt is rotatably wound.

To achieve at least one of the abovementioned objects, according to an aspect of the present invention, an image forming apparatus reflecting one aspect of the present invention comprises an image forming device that forms a toner image on a recording medium transported along a transport path, and the fixing device that fixes the toner image onto the recording medium transported along the transport path.

To achieve at least one of the abovementioned objects, according to an aspect of the present invention, a method of an endless belt for an image forming apparatus reflecting one aspect of the present invention comprises: preparing an endless belt including an endless base layer, an elastic layer provided on the base layer, and a surface layer provided on the elastic layer and containing fluororesin; and spot-irradiating the surface layer with laser light having an ultraviolet-region wavelength to form at least one mark portion.

The foregoing and other objects, features, aspects and advantages of the present invention will become more apparent from the following detailed description of the present invention when taken in conjunction with the accompanying drawings.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 8 shows the conditions and results of a first verification experiment conducted for verifying the effects of the embodiment;

FIG. 9 shows the conditions and results of a second verification experiment conducted for verifying the effects of the embodiment; and FIG. 10 shows the conditions and results of a third verification experiment conducted for verifying the effects of the embodiment.

DETAILED DESCRIPTION OF EMBODIMENTS

Figure 1:
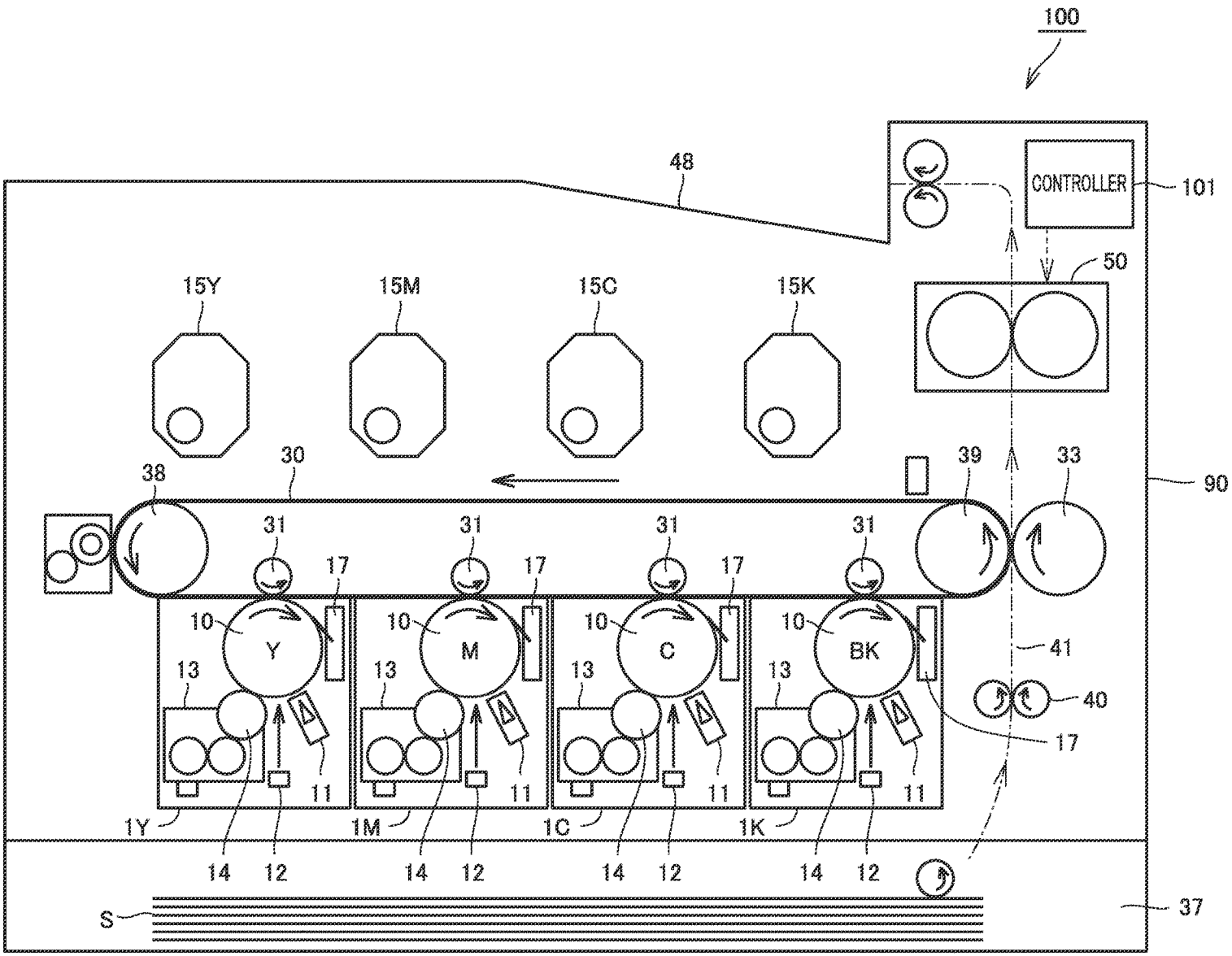
FIG. 1 is a schematic view of an image forming apparatus according to an embodiment.

Hereinafter, one or more embodiments of the present invention will be described with reference to the drawings. However, the scope of the invention is not limited to the disclosed embodiments.

It should be noted that in the following embodiments, the same or corresponding parts are denoted by the same reference numerals, and the description thereof will not be repeated.

Embodiment 1

[Image Forming Apparatus]

FIG. 1 is a schematic view of an image forming apparatus according to an embodiment. An image forming apparatus 100 according to the embodiment will now be described with reference to FIG. 1.

FIG. 1 shows image forming apparatus 100 serving as a color printer. Although image forming apparatus 100 serving as a color printer will be described below, image forming apparatus 100 is not limited to the color printer. For example, image forming apparatus 100 may be a monochrome printer, a facsimile machine, or a multi-functional peripheral (MFP) of a monochrome printer, a color printer, and a facsimile machine.

Image forming apparatus 100 includes image forming units 1Y, 1M, 1C, and 1K, an intermediate transfer belt 30, primary transfer rollers 31, a secondary transfer roller 33, a cassette 37, a driven roller 38, a driving roller 39, a timing roller 40, a fixing device 50, a housing 90, and a controller 101.

Housing 90 defines the outer shell of image forming apparatus 100. Housing 90 accommodates image forming units 1Y, 1M, 1C, and 1K, intermediate transfer belt 30, primary transfer rollers 31, secondary transfer roller 33, cassette 37, driven roller 38, driving roller 39, timing roller 40, fixing device 50, and controller 101.

Image forming units 1Y, 1M, 1C, and 1K, intermediate transfer belt 30, primary transfer rollers 31, secondary transfer roller 33, driven roller 38, and driving roller 39 constitute an image forming device. This image forming device forms a toner image on a sheet S serving as a recording medium transported along a transport path 41, which will be described below.

Image forming units 1Y, 1M, 1C, and 1K are arranged in order along intermediate transfer belt 30. Image forming unit 1Y is supplied with toner from a toner bottle 15Y to form a yellow (Y) toner image. Image forming unit 1M is supplied with toner from a toner bottle 15M to form a magenta (M) toner image. Image forming unit 1C is supplied with toner from a toner bottle 15C to form a cyan (C) toner image. Image forming unit 1K is supplied with toner from a toner bottle 15K to form a black (BK) toner image.

Image forming units 1Y, 1M, 1C, and 1K are disposed in order in the direction of rotation of intermediate transfer belt 30 along intermediate transfer belt 30. Image forming units 1Y, 1M, 1C, and 1K each include a photoconductor 10, a charging device 11, an exposing device 12, a developing device 13, and a cleaning device 17.

Charging device 11 charges the surface of photoconductor 10 uniformly. Exposing device 12 irradiates photoconductor 10 with laser light in response to a control signal from controller 101, thereby exposing the surface of photoconductor 10 to light in accordance with an input image pattern. An electrostatic latent image corresponding to the input image is thus formed on photoconductor 10.

Developing device 13 applies a developing bias to a developing roller 14 while rotating developing roller 14, thus causing the toner to adhere to the surface of developing roller 14. Consequently, the toner is transferred from developing roller 14 to photoconductor 10, so that a toner image corresponding to the electrostatic latent image is developed on the surface of photoconductor 10.

Photoconductor 10 and intermediate transfer belt 30 are in contact with each other at a position at which primary transfer roller 31 is provided. Primary transfer roller 31 has a roller shape and is configured to be rotatable. A transfer voltage of the polarity opposite to that of the toner image is applied to primary transfer roller 31, causing the toner image to be transported from photoconductor 10 to intermediate transfer belt 30. The yellow (Y) toner image, the magenta (M) toner image, the cyan (C) toner image, and the black (BK) toner image are overlaid in order to be transferred from photoconductor 10 onto intermediate transfer belt 30. Consequently, a color toner image is formed on intermediate transfer belt 30.

Intermediate transfer belt 30 is laid across driven roller 38 and driving roller 39. Driving roller 39 is drivingly rotated by, for example, a motor (not shown). Intermediate transfer belt 30 and driven roller 38 rotate along with driving roller 39. Consequently, the toner image on intermediate transfer belt 30 is transported to secondary transfer roller 33.

Cleaning device 17 is pressed against photoconductor 10. Cleaning device 17 collects the toner remaining on the surface of photoconductor 10 after the transfer of the toner image.

Sheets S are set in cassette 37. Sheets S are transported one by one from cassette 37 along transport path 41 to secondary transfer roller 33 by timing roller 40. Secondary transfer roller 33 has a roller shape and is configured to be rotatable. Secondary transfer roller 33 applies a transfer voltage of the polarity opposite to that of the toner image to sheet S being transported. This causes the toner image to be attracted from intermediate transfer belt 30 to secondary transfer roller 33, so that the toner image on intermediate transfer belt 30 is transferred. A timing at which sheet S is transported to secondary transfer roller 33 is adjusted by timing roller 40 in accordance with the position of the toner image on intermediate transfer belt 30. Timing roller 40 allows the toner image on intermediate transfer belt 30 to be transferred to an appropriate position of sheet S.

Fixing device 50 pressurizes and heats sheet S passing therethrough. The toner image is accordingly fixed onto sheet S. In this manner, fixing device 50 fixes the toner image on sheet S transported along transport path 41. Sheet S with the toner image fixed thereon is ejected to a tray 48.

Although image forming apparatus 100 adopting a tandem method as a printing method has been described above, the printing method of image forming apparatus 100 is not limited to the tandem method. The arrangement of the components in image forming apparatus 100 can be changed appropriately in accordance with the printing method adopted. The printing method of image forming apparatus 100 may be a rotary method or a direct transfer method. In the case of the rotary method, image forming apparatus 100 is composed of one photoconductor 10, and a plurality of developing devices 13 configured to be rotatable on the same axis. In printing, image forming apparatus 100 guides developing devices 13 sequentially to photoconductor 10 to develop toner images of the respective colors. In the case of the direct transfer method, image forming apparatus 100 directly transfers the toner image formed on photoconductor 10 to sheet S.

[Fixing Device]

Figure 2:
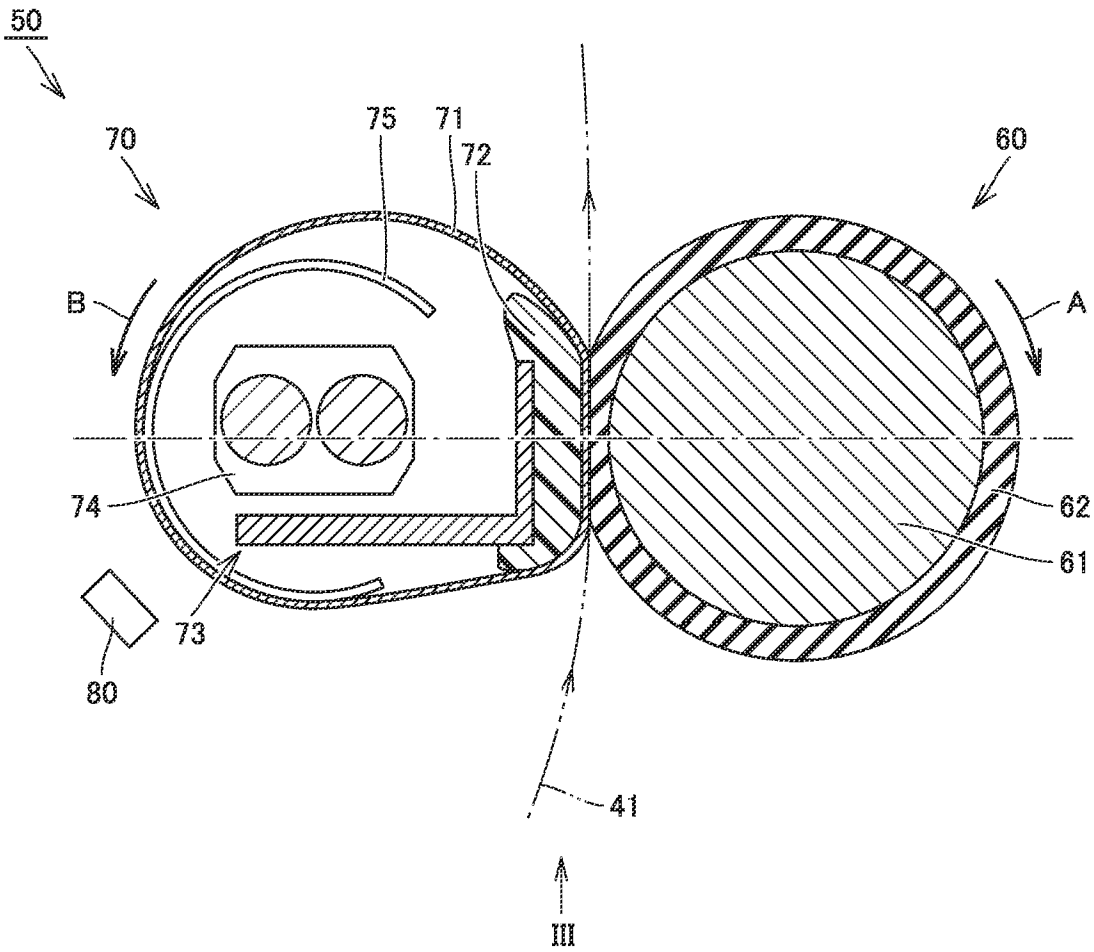
FIG. 2 is a schematic sectional view of a fixing device according to the embodiment.
Figure 3:
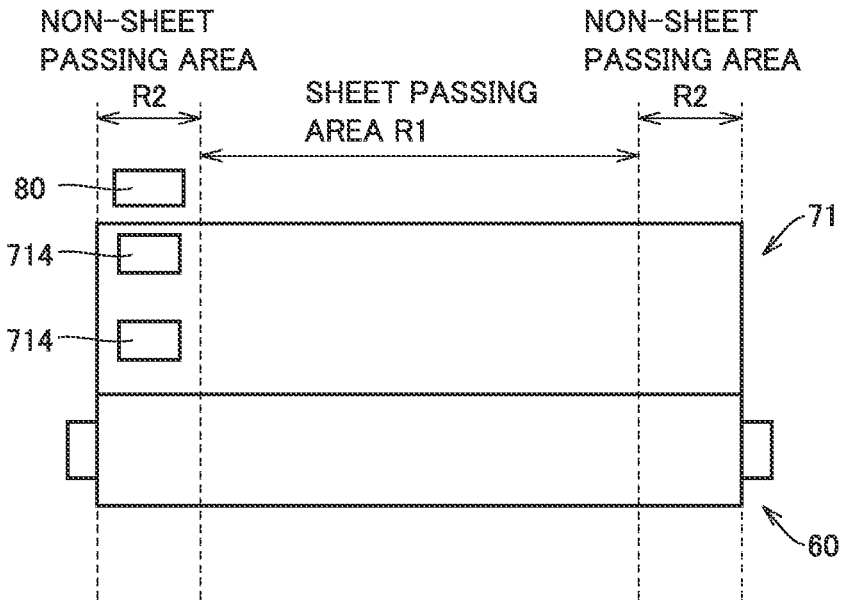
FIG. 3 shows the fixing device seen from arrow III in FIG. 2.

FIG. 2 is a schematic sectional view of the fixing device according to the embodiment. FIG. 3 shows the fixing device seen from arrow III in FIG. 2. Fixing device 50 according to the embodiment will be described with reference to FIGS. 2 and 3.

As shown in FIGS. 2 and 3, fixing device 50 mainly includes a pressure roller 60, a fixing belt unit 70, and a rotation detector 80 that detects the number of rotations of fixing belt 71 of fixing belt unit 70.

Pressure roller 60 is formed of a metal core bar 61 made of, for example, aluminum alloy or the like, and a rubber elastic layer 62 provided to cover core bar 61 and made of, for example, silicone rubber. Pressure roller 60 has a diameter of, for example, 25 mm. Elastic layer 62 has a thickness of, for example, 3 mm. Pressure roller 60 may further include a mold release layer provided to cover elastic layer 62 and made of, for example, fluorine-containing resin.

Pressure roller 60 is disposed to face the outer circumferential surface of fixing belt 71. Pressure roller 60 is disposed to catch the fixing belt between a pad member 72 serving as a winding member, which will be described below, and pressure roller 60.

The pressure roller 60 includes a contact portion that contacts a passage area through which mark portions 714 (see FIG. 3) provided in a surface layer 713 (see FIG. 4) of fixing belt 71, described below, pass by the rotation of fixing belt 71. The contact portion is made of rubber such as silicone rubber. The rubber is lower in releasability than surface layer 713 of fixing belt 71, which will be described below, and accordingly exhibits a cleaning function. Thus, a foreign matter such as paper dust or toner adhering to mark portion 714 can be removed when the contact portion slides on mark portion 714.

The opposite ends of pressure roller 60 in its axial direction are pivotally supported in a rotatable manner by a shaft support (not shown). Pressure roller 60 is rotatably driven by, for example, drive means (not shown) such as a motor. Pressure roller 60 rotates in the arrow A direction. Pressure roller 60 is configured to be elastically biased toward fixing belt unit 70 by a biasing member (not shown).

Fixing belt unit 70 mainly includes a pad member 72, a support member 73, and a pair of belt guides 75, in addition to fixing belt 71 and heating source 74 described above.

Fixing belt 71 is endless. Fixing belt 71 is rotatably wound around pad member 72 and the pair of belt guides 75 serving as a plurality of winding members. Fixing belt 71 rotates in the arrow B direction. Fixing belt 71 includes a sheet passing area R1 through which a recording medium passes and a non-sheet passing area R2 located outside sheet passing area R1 in the rotational axis direction of the fixing belt. Fixing belt 71 is provided with a plurality of mark portions 714. The detailed configuration of fixing belt 71 will be described below with reference to FIG. 4.

Pad member 72 is formed of an elongated member extending in the axial direction of pressure roller 60 and is disposed in the space inside fixing belt 71. Pad member 72 has a substantially C-shaped cross section orthogonal to the longitudinal direction. Pad member 72 is made of, for example, liquid crystal polymer.

Support member 73 is formed of an elongated member extending in the axial direction of pressure roller 60 and is mostly located in the space inside fixing belt 71. Support member 73 is provided to support pad member 72. Support member 73 has a substantially L-shaped cross section in its portion disposed in the space inside fixing belt 71. Support member 73 is formed of, for example, a metal member such as electrogalvanized steel sheet (SECC).

Heating source 74 extends parallel to the axial direction of pressure roller 60. Heating source 74 heats fixing belt 71.

The pair of belt guides 75 are provided at positions of the space inside fixing belt 71 which correspond to the opposite ends of pressure roller 60 in the axial direction. The pair of belt guides 75 have a substantially C-shaped cross section, and fixing belt 71 is rotatably wound around the outer circumferential surface thereof. The pair of belt guides 75 are fixed to, for example, the side wall of a housing that forms fixing device 50 or a chassis provided inside housing 90 of image forming apparatus 100, thus guiding the rotation of fixing belt 71.

Rotation detector 80 is disposed facing surface layer 713 of fixing belt 71 (see FIG. 4), which will be described below.

Rotation detector 80 is, for example, a reflective sensor. Rotation detector 80 has a light emitting portion 81 and a light receiving portion 82. Light emitting portion 81 emits light toward a part of the passage area of surface layer 713 of fixing belt 71, described below, through which mark portion 714 passes. Light receiving portion 82 receives the light reflected off the part of the passage area.

Rotation detector 80 detects changes in the light received by light receiving portion 82 and detects the number of rotations of fixing belt 71. The detection results detected by rotation detector 80 are supplied to controller 101. Controller 101 controls the number of rotations of fixing belt 71 based on the detection results.

[Details of Fixing Belt]

Figure 4:
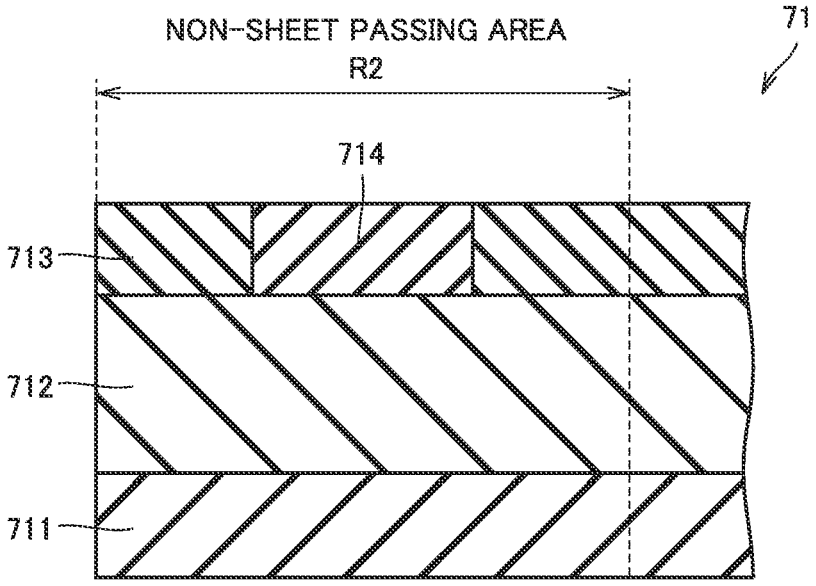
FIG. 4 is a schematic sectional view of the fixing belt according to the embodiment.

FIG. 4 is a schematic sectional view of the fixing belt according to the embodiment. With reference to FIGS. 3 and 4, a detailed configuration of fixing belt 71 will now be described.

As shown in FIGS. 3 and 4, fixing belt 71 includes a base layer 711 shaped into an endless belt, an elastic layer 712 provided on base layer 711, and surface layer 713 provided on elastic layer 712. It should be noted that an adhesive layer for adhesion may be provided between the layers. The adhesive layer is, for example, made of adhesive.

Base layer 711 is preferably made of a material that is flexible, has a good mechanical strength, and is resistant to heat, such as polyimide resin, polyamide resin, polyamide-imide resin, polyether ether ketone (PEEK) resin, polyether sulphone (PES) resin, polyphenylene sulfide (PPS) resin, tetrafluoroethylene-perfluoro (alkyl vinyl ether) copolymer (PFA) resin, polytetrafluoroethylene (PTFE) resin, or tetrafluoroethylene-hexafluoropropylene copolymer (I-EP) resin.

Elastic layer 712 is preferably made of silicone rubber, fluororubber, or fluoro-silicone rubber that has excellent heat resistance and excellent thermal conductivity.

Surface layer 713 contains fluororesin. Surface layer 713 is preferably made of a material having excellent releasability. Surface layer 713 is preferably made of, for example, PFA resin, PTFE resin, or I-EP resin. In particular, PFA resin is desirable from the viewpoints of moldability and toner releasability. A non-limiting example of the PFA resin is Teflon (trademark) from Chemours-Mitsui Fluoroproducts Co., Ltd.

Surface layer 713 is provided with mark portions 714. Mark portions 714 are provided in non-sheet passing area R2. Mark portions 714 are disposed apart from each other in the circumferential direction of fixing belt 71. It should be noted that mark portions 714 may be disposed at regular intervals in the circumferential direction of an endless belt.

The width of mark portion 714 in the rotational axis direction of fixing belt 71 is preferably equal to or more than the spot diameter of the outgoing light emitted from light emitting portion 81 of rotation detector 80, which will be described below, and equal to or less than 20 mm.

Since the outgoing light is emitted across mark portions 714 and a portion that is not marked when the width of mark portion 714 is smaller than the spot diameter of the outgoing light, rotation detector 80 cannot sufficiently detect the light reflected off mark portion 714. When the width of mark portion 714 is greater than 20 mm, the width of fixing belt 71 increases, resulting in an increased width of image forming apparatus 100.

The length of mark portion 714 in the circumferential direction of fixing belt 71 is preferably equal to or more than the spot diameter of the outgoing light emitted from light emitting portion 81 and equal to or less than a value obtained by dividing the circumferential length of fixing belt 71 by twice the number of mark portions 714.

When the length of mark portion 714 is smaller than the spot diameter of the outgoing light, the light emitted from light emitting portion 81 is emitted across mark portions 714 and a portion that is not marked, and thus, rotation detector 80 cannot sufficiently detect the light reflected off mark portion 714. When the length of mark portion 714 is greater than a value obtained by dividing the circumferential length of fixing belt 71 by twice the number of mark portions 714, the length of the region that is not marked is small in the circumferential direction. Mark portions 714 are formed through alteration of predetermined regions by spot irradiation of predetermined regions of surface layer 713 with laser light having an ultraviolet-range wavelength.

A difference in optical reflectance between mark portion 714 and the portion of surface layer 713 in which mark portion 714 is not provided is preferably 20% or more.

When fixing belt 71 rotates, fixing belt 71 may vibrate. When the temperature in fixing device 50 varies, the detection accuracy in rotation detector 80 also varies. Thus, setting a difference in optical reflectance to 20% or more allows rotation detector 80 to reliably detect the presence or absence of mark portion 714. Mark portion 714 may have a size of 25 $mm^2$ or more. As described above, mark portion 714 is formed by irradiation with light having an ultraviolet-region wavelength. Compared with infrared rays, the light having an ultraviolet-region wavelength has a low degree of effect of vibrating the molecules of an irradiation target to generate heat, and accordingly can prevent or reduce heat-induced effects.

When infrared rays are emitted such that mark portion 714 has a size of 25 $mm^2$ or more, surface layer 713 may be melted due to heat. In the embodiment, surface layer 713 is irradiated with the light having an ultraviolet-region wavelength. This can prevent or reduce melting of surface layer 713, and also prevent or reduce floating of a part of surface layer 713 from elastic layer 712 due to thermal damage to the adhesive layer located between surface layer 713 and elastic layer 712.

[Method of Manufacturing Fixing Belt]

Figure 5:
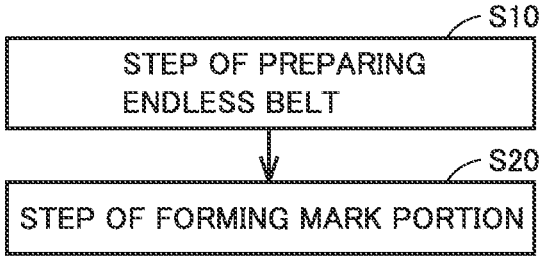
FIG. 5 is a flowchart showing steps of manufacturing the fixing belt according to the embodiment.
Figure 6:
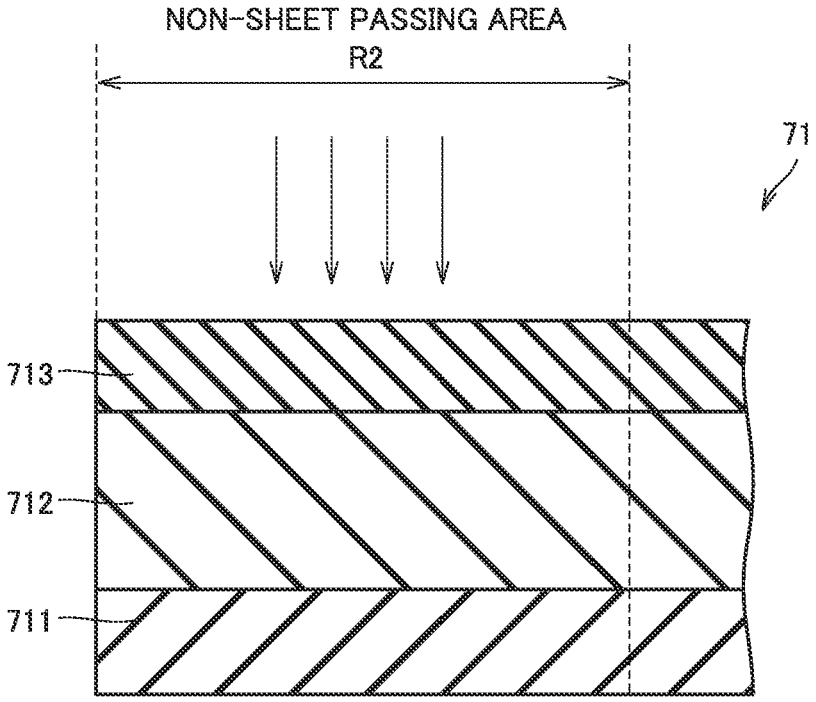
FIG. 6 shows the step of forming a mark portion shown in FIG. 5.
Figure 7:
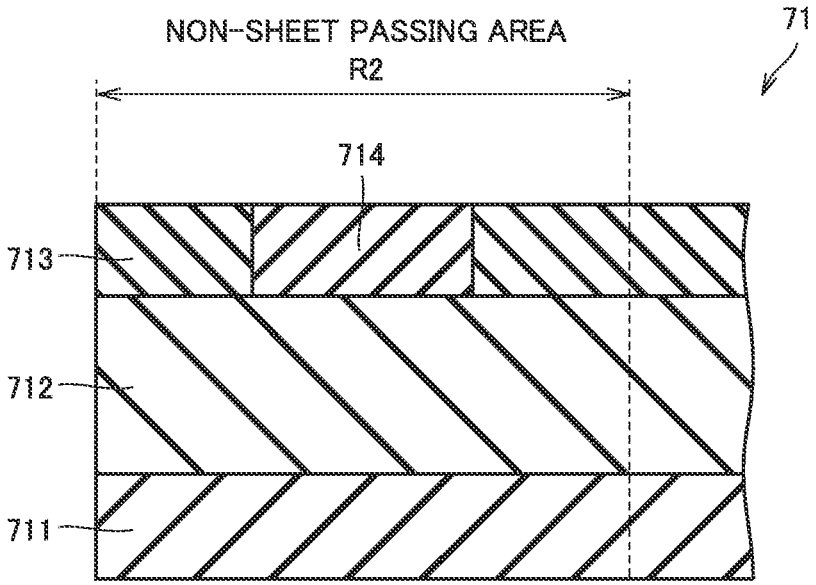
FIG. 7 shows the state after the step of forming a mark portion in FIG. 5.

FIG. 5 is a flowchart showing steps of manufacturing the fixing belt according to the embodiment. FIG. 6 shows the step of forming a mark portion shown in FIG. 5. FIG. 7 shows the state after the step of forming the mark portion in FIG. 5. A method of manufacturing fixing belt 71 according to the embodiment will be described with reference to FIGS. 5 to 7.

As shown in FIG. 5, in manufacturing a fixing belt 71, an endless belt is prepared first in step S10. Specifically, an endless belt is prepared that includes an endless base layer 711, an elastic layer 712 provided on base layer 711, and a surface layer 713 provided on elastic layer 712 and containing fluororesin.

Endless base layer 711 is manufactured by a conventionally known manufacturing method. For example, a resin serving as a material is melted by an extruder, and the melted resin is shaped into a tube by an inflation method with an annular die. The tubular resin is sliced, so that endless base layer 711 is formed.

In preparing an endless belt, endless base layer 711 is disposed on the outer surface of a tubular inner mold having an inside-diameter dimension of the fixing belt. Subsequently, the outside of the base layer member is covered with an adhesive sheet. Further, the outside of the adhesive sheet is covered with an elastic layer member. Subsequently, the outside of the elastic layer member is covered with an adhesive sheet. Further, the outside of the adhesive sheet is covered with a surface layer member containing fluororesin. In this state, the tubular inner mold is heated in its entirety. Consequently, the adhesive sheet is melted, the elastic layer member is fixed to the base layer member, and the surface layer is fixed to the elastic member. Subsequently, the tubular inner mold is cut in a desired length, and the endless belt with the base layer, the elastic layer, and the surface layer stacked in order is removed from the inner mold.

In step S20, mark portion 714 is subsequently formed. Specifically, surface layer 713 is spot-irradiated with laser light having an ultraviolet-region wavelength to form at least one mark portion 714. Irradiating surface layer 713 with the laser light alters an irradiated portion of surface layer 713, and this portion turns into mark portion 714.

In mark portion 714, a chemical bond of molecules of surface layer 713 is cleaved by the laser light having an ultraviolet-region wavelength. Mark portion 714 is thus discolored more than surface layer 713 that is not irradiated with laser light.

Irradiation with laser light having an ultraviolet-region wavelength can reduce heat-induced damage to fixing belt 71 more than irradiation with laser light having an infrared-region wavelength. Specifically, an adhesive layer located between surface layer 713 and elastic layer 712 is damaged due to heat, thus preventing or reducing floating of a part of surface layer 713 from elastic layer 712.

Also, a part of surface layer 713 is altered by the laser light having an ultraviolet-region wavelength, thus forming mark portion 714 with high sharpness.

In irradiation with the laser light having an ultraviolet-region wavelength, the laser light is preferably pulsed such that the laser light preferably has a pulse interval equal to more than a spot diameter of the laser light and equal to or less than twice the spot diameter of the laser light.

When the pulse interval of the laser light is less than the spot diameter of the laser light, a certain portion of fixing belt 71 is irradiated with the laser light doubly, which may cause minute floating of surface layer 713. When the pulse interval of the laser light is greater than twice the spot diameter of the laser light, the sharpness of mark portion 714 may reduce.

In forming mark portion 714, laser light is preferably pulsed such that the laser light has energy of 0.01 mJ or more and 0.2 mJ or less per pulse.

When the energy of the laser light per pulse is smaller than 0.01 mJ, the degree of alteration of surface layer 713 decreases, which may reduce a difference in reflectance between mark portion 714 and a portion of surface layer 713 in which mark portion 714 is not formed. When the energy of the laser light per pulse is greater than 0.2 mJ, a heat-induced effect increases, which may cause floating of surface layer 713.

In forming mark portion 714, mark portion 714 is formed such that a difference in optical reflectance between the portion of surface layer 713 in which mark portion 714 is not provided and mark portion 714 is 20% or more. This allows rotation detector 80 to reliably detect the presence or absence of mark portion 714.

In forming mark portion 714, mark portion 714 may be formed to have a size of 25 $mm^2$ or more. When such a size is achieved, heat-induced damage can be reduced more than when visible light or light having an infrared-region wavelength is emitted. This can prevent or reduce floating of a part of surface layer 713 from elastic layer 712.

[Verification Experiments]

FIG. 8 shows the conditions and results of a first verification experiment conducted to verify the effects of the embodiment. The conditions and results of the first verification experiment conducted to verity the effects of the embodiment will be described with reference to FIG. 8.

As shown in FIG. 8, in the first verification experiment, mark portions were formed while changing the wavelength of the laser light emitted onto surface layer 713, the pulse interval of the laser light, and the spot diameter of the laser light.

Used as the laser light were an ultraviolet laser having an ultraviolet-region wavelength, a visible-light laser having a visible-range wavelength, and an infrared laser having an infrared-range wavelength. Two types of lasers were used as the ultraviolet laser, which had wavelengths of 266 nm and 355 nm. One type of laser was used as the visible-light laser, which had a wavelength of 532 nm. Three types of lasers were used as the infrared laser, which had wavelengths of 1064 nm, 9300 nm, and 10600 nm.

In each laser of the ultraviolet lasers, the visible-light laser, and the infrared lasers, the relationships between a pulse interval pt and a spot diameter d were pt<d, pt=d, 2d>pt>d, pt=2d, and pt>2d. The pulse intervals pt were 35 μm, 25 μm, and 45 μm.

Mark portions 714 were formed on the above conditions, and the formed mark portions 714 were checked for the following: whether the formed mark portion 714 peeled off elastic layer 712 and floated, and the difference in optical reflectance between a portion of surface layer 713 with no mark portion provided and a mark portion was 20% or more.

As to the determination of the floating state (determination of floating) of mark portion 714, an evaluation was made by visually observing a cross section of fixing belt 71 passing through mark portion 714 and orthogonal to the circumferential direction of the fixing belt.

In the determination of floating, the state in which mark portion 714 floated from the elastic layer and this floating greatly affected damage to fixing belt 71 was determined poor. The state in which a part of mark portion 714 floated but the floating little affected damage to fixing belt 71 was determined fair. The state in which mark portion 714 did not float from the elastic layer and the floating did not affect damage to fixing belt 71 was determined good.

A difference in optical reflectance was calculated by measuring spectral reflectances of mark portion 714 and a portion of surface layer 713 with no mark portion 714 formed, using a spectrophotometer U-4100 (Hitachi, Ltd.). In this calculation, a spectral reflectance at a wavelength of 870 nm was measured.

In the evaluation of a reflectance difference, a reflectance difference smaller than 20% was determined poor. A reflectance of not less than 20% and almost 20% was determined fair. A reflectance considerably exceeding 20% was determined good.

When the used lasers were ultraviolet lasers and had wavelengths of 266 nm and 355 nm, in any case, both of the determination of floating and the evaluation of reflectance difference were good if the relationship between pulse interval pt and spot diameter d was d<pt<2d. If the relationship between pulse interval pt and spot diameter d was pt<d, the determination of floating was good, and the evaluation of reflectance difference was fair. If the relationship between pulse interval pt and spot diameter d was pt>2d, the determination of floating was fair, and the evaluation of reflectance difference was good.

When the used laser was a visible-light laser and had a wavelength of 532 nm, both of the determination of floating and the evaluation of reflectance difference were good in no case. If d<pt, the determination of floating of the visible-light laser was poor, resulting in more conspicuous floating of mark portion 714 than in the case of the ultraviolet laser.

When the used laser was an infrared laser and had a wavelength of 1064 nm, both of the determination of floating and the evaluation of reflectance difference were good in no case. If d<pt, the determination of floating of the visible-light laser was poor, resulting in more conspicuous floating of mark portion 714 than in the case of an ultraviolet laser.

When the used laser was an infrared laser and had a wavelength of 9300 nm, both of the determination of floating and the evaluation of reflectance difference were good in no case. The determination of floating of the visible-light laser was poor when the relationship between pulse interval pt and spot diameter d had any relationship, resulting in more conspicuous floating of mark portion 714 than in the case of the ultraviolet laser.

When the used laser was an infrared laser and had a wavelength of 10600 nm, both of the determination of floating and the evaluation of reflectance difference were good in no case. The determination of floating of the visible-light laser was poor when the relationship between pulse interval pt and spot diameter d had any relationship, resulting in more conspicuous floating of mark portion 714 than in the case of the ultraviolet laser.

The above results confirmed that irradiating surface layer 713 with a laser having an ultraviolet-region wavelength alters a part of surface layer 713 to form mark portion 714, thus preventing or reducing floating of surface layer 713 from elastic layer 712.

It was also confirmed that irradiating surface layer 713 with a laser having an ultraviolet-region wavelength alters a part of surface layer 713 to form mark portion 714, yielding a reflectance difference of 20% or more, which results in the formation of sharp mark portion 714.

In particular, it was confirmed that when a laser having an ultraviolet wavelength is emitted and the relationship between pulse interval pt and spot diameter d is d<pt<2d, floating of surface layer 713 from elastic layer 712 can be prevented or reduced satisfactorily and a sharp mark portion can be formed.

FIG. 9 shows the conditions and results of a second verification experiment conducted to verify the effects of the embodiment. The conditions and results of the second verification experiment conducted to verity the effects of the embodiment will be described with reference to FIG. 9.

As shown in FIG. 9, in the second verification experiment, mark portions were formed while changing the wavelength of laser light emitted onto surface layer 713, the pulse interval of the laser light, the spot diameter of the laser light, and energy of the laser light per pulse.

Used as the laser light was only an ultraviolet laser having an ultraviolet-region wavelength. Two types of lasers were used as the ultraviolet laser, which had wavelengths of 266 nm and 355 nm. In each of the ultraviolet lasers, the relationships between pulse interval pt and spot diameter d were pt<d, pt=d, 2d>pt>d, pt=2d, and pt>2d.

The conditions for energy per pulse were divided into the following three cases: a case in which energy per pulse is smaller than 0.01 mJ, a case in which energy per pulse is 0.01 mJ or more and 0.2 mJ or less, and a case in which energy per pulse is greater than 0.2 mJ.

Mark portions 714 were formed on the above conditions, and the formed mark portions 714 were checked for the following: whether mark portion 714 peeled off elastic layer 712 and floated, and the difference in optical reflectance between a portion of surface layer 713 with no mark portion provided and a mark portion was 20% or more. The determination of floating of mark portion 714 and the evaluation of a difference in optical reflectance were made as in the first verification experiment.

When the used lasers were ultraviolet lasers and had wavelengths of 266 nm and 355 nm and when the energy per pulse was 0.01 mJ or more and 0.2 mJ or less, in any relationship between pulse interval pt and spot diameter d, the determination of floating was fair or good, and the evaluation of reflectance difference was also fair or good.

When the used lasers were ultraviolet lasers and had wavelengths of 266 nm and 355 nm and the relationship between pulse interval pt and spot diameter d was d<pt<2d, both of the determination of floating and the evaluation of reflectance difference were good even when the energy per pulse was in any of the above ranges.

The above results confirmed that in forming mark portion 714, laser light is preferably pulsed such that the energy of laser light per pulse is 0.01 mJ or more and 0.2 mJ or less.

FIG. 10 shows the conditions and results of a third verification experiment conducted to verify the effects of the embodiment. The conditions and results of the third verification experiment conducted to verity the effects of the embodiment will be described with reference to FIG. 10.

As shown in FIG. 10, the wavelength of the laser light emitted onto surface layer 713 and the size (area) of a mark portion to be formed were varied in the third verification experiment.

Used as the laser light were an ultraviolet laser having an ultraviolet-region wavelength, a visible-light laser having a visible-range wavelength, and an infrared laser having an infrared-range wavelength. Two types of lasers were used as the ultraviolet laser, which had wavelengths of 266 nm and 355 nm. One type of laser was used as the visible-light laser, which had a wavelength of 532 nm. Three types of lasers were used as the infrared laser, which had wavelengths of 1064 nm, 9300 nm, and 10600 nm.

The ultraviolet lasers, the visible-light laser, and the infrared lasers were each used to form mark portions 714 having sizes of 1 $mm^2$, 5 $mm^2$, 10 $mm^2$, 25 $mm^2$, and 30 $mm^2$.

The relationship between pulse interval pt and spot diameter d was d<pt<2d, and the energy per pulse was 0.01 mJ or more and 0.2 mJ or less.

Whether mark portions 714 formed on the above conditions peeled off elastic layer 712 and floated was checked. The determination of floating of mark portion 714 was evaluated as in the first verification experiment.

When the used lasers were the ultraviolet lasers and had wavelengths of 266 nm and 355 nm, the determination of floating of mark portion 714 was good when mark portion 714 had any size.

When the used laser was the visible-light laser and had a wavelength of was 532 nm, the determination of floating of mark portion 714 was good when the size of mark portion 714 was 25 $mm^2$ or less, while the determination of floating of mark portion 714 was poor when the size of mark portion 714 was 30 $mm^2$.

When the used lasers were the infrared lasers and had wavelengths of 1064 nm, 9300 nm, and 10600 nm, in any case, the determination of floating of mark portion 714 was good when the size of mark portion 714 was 10 $mm^2$ or less, whereas the determination of floating of mark portion 714 was poor when the size of mark portion 714 was 25 $mm^2$ or more.

The above results confirmed that the ultraviolet laser having an ultraviolet-region wavelength has a weak effect of vibrating molecules of an irradiation target to generate heat compared with the infrared laser, preventing or reducing a heat-induced effect, which prevents or reduces floating of mark portion 714. In particular, the above effect was confirmed conspicuously when the size of mark portion 714 was 25 $mm^2$ or more.

Although the above embodiment has described the case in which an endless belt is used as fixing belt 71 by way of example, the present invention is not limited thereto. Alternatively, the endless belt may be used as intermediate transfer belt 30 or a transport belt for transporting a recording medium.

An endless belt based on the present invention is used in an image forming apparatus and includes an endless base layer, an elastic layer provided on the base layer, and a surface layer provided on the elastic layer. The surface layer contains fluororesin. The surface layer is provided with at least one mark portion formed through alteration of a part of the surface layer by irradiation of the surface layer with laser light having an ultraviolet-region wavelength.

In the endless belt based on the present invention, the laser light may be pulsed. In this case, the pulse interval of the laser light is preferably equal to or more than the spot diameter of the laser light and equal to or less than twice the spot diameter of the laser light.

In the endless belt based on the present invention, the laser light may be pulsed. In this case, the leaser light has energy of 0.01 mJ or more and 0.2 mJ or less per pulse.

In the endless belt based on the present invention, a difference in optical reflectance between a portion of the surface layer with no mark portion provided and the mark portion is preferably 20% or more.

In the endless belt based on the present invention, the mark portion preferably has a size of 25 $mm^2$ or more.

A fixing device based on the present invention includes the endless belt and a plurality of winding members around which the endless belt is rotatably wound.

In the fixing device based on the present invention, the endless belt may include a sheet passing area through which a recording medium passes and a non-sheet passing area located outside the sheet passing area in the rotation axis direction of the endless belt. In this case, the mark portion is preferably provided in the non-sheet passing area.

The fixing device according to the present invention preferably further includes a pressure roller disposed to catch the endless belt between any of the plurality of winding members and the pressure roller. In this case, a portion of the pressure roller which contacts the mark portion is preferably made of rubber.

The fixing device based on the present invention may further include a pressure roller disposed to catch the endless belt between any of the plurality of winding members and the pressure roller. The surface layer may include a passage area through which the mark portion passes by rotation of the endless belt, and the pressure roller may include a contact portion that contacts the passage area. In this case, the contact portion is made of rubber.

The fixing device based on the present invention may further include a rotation detector that is disposed facing the surface layer and detects the number of rotations of the endless belt, and the surface layer may include a passage area through which the mark portion passes by rotation of the endless belt. In this case, the rotation detector preferably includes a light emitting portion that emits light toward a part of the passage area and a light receiving portion that receives the light reflected off the part of the passage area, and the rotation detector preferably detects changes in the right received by the light receiving portion to detect the number of rotations of the endless belt.

In the fixing device based on the present invention, the width of the mark portion in the rotation axis direction of the endless belt is preferably equal to or more than the spot diameter of the light emitted from the light emitting portion and equal to or less than 20 mm. Further, the length of the mark portion in the circumferential direction of the endless belt is preferably equal to or more than the spot diameter of the light emitted from the light emitting portion and equal to or less than a value obtained by dividing the circumferential length of the endless belt by twice the number of mark portions.

In the fixing device based on the present invention, the surface layer may be provided with a plurality of the mark portions. In this case, the plurality of mark portions may be disposed at regular intervals in the circumferential direction of the endless belt.

The image forming apparatus based on the present invention includes an image forming device that forms a toner image on a recording medium transported along a transport path, and the fixing device that fixes the toner image onto the recording medium transported along the transport path.

A method of manufacturing an endless belt based on the present invention is a method of manufacturing an endless belt for used in an image forming apparatus. The method of manufacturing an endless belt based on the present invention includes preparing an endless belt including an endless base layer, an elastic layer provided on the base layer, and a surface layer provided on the elastic layer and containing fluororesin, and spot-irradiating the surface layer with laser light having an ultraviolet-region wavelength to form at least one mark portion.

In the method of manufacturing an endless belt based on the present invention, in the forming of the mark portion, the laser light is preferably pulsed such that the laser light has a pulse interval of preferably equal to or more than the spot diameter of the laser light and equal to or less than twice the spot diameter of the laser light.

In the method of manufacturing an endless belt based on the present invention, in the forming of the mark portion, the laser light is preferably pulsed such that the laser light has energy of 0.01 mJ or more and 0.2 mJ or less per pulse.

In the method of manufacturing an endless belt based on the present invention, in the forming of the mark portion, the mark portion is preferably formed such that a difference in optical reflectance between a portion of the surface layer in which the mark portion is not provided and the mark portion is 20% or more.

In the method of manufacturing an endless belt based on the present invention, in the forming of the mark portion, the mark portion is preferably formed to have a size of 25 $mm^2$ or more.

Although embodiments of the present invention have been described and illustrated in detail, it is clearly understood that the same is by way of illustration and example only and not limitation, the scope of the present invention should be interpreted by terms of the appended claims.

What is claimed is:

1. An endless belt for an image forming apparatus, the endless belt comprising:

an endless base layer;

an elastic layer provided on the base layer; and a surface layer provided on the elastic layer, the surface layer containing fluororesin, the surface layer being provided with at least one mark portion, the at least one mark portion being formed through alteration of a part of the surface layer by irradiation of the surface layer with laser light having an ultraviolet-region wavelength, wherein the laser light is pulsed, the laser light has a pulse interval equal to or more than a spot diameter of the laser light and equal to or less than twice the spot diameter of the laser light, and a surface of the mark portion is flat.

2. The endless belt according to claim 1, wherein the laser light has energy of 0.01 mJ or more and 0.2 mJ or less per pulse.

3. The endless belt according to claim 1, wherein a difference in optical reflectance between a portion of the surface layer in which the mark portion is not provided and the mark portion is 20% or more.

4. The endless belt according to claim 1, wherein the mark portion has a size of 25 $mm^2$ or more.

5. A fixing device comprising:

an endless belt according to claim 1; and a plurality of winding members around which the endless belt is rotatably wound.

6. The fixing device according to claim 5, wherein the endless belt includes a sheet passing area through which a recording medium passes, and a non-sheet passing area located outside the sheet passing area in a rotational axis direction of the endless belt, and the mark portion is provided in the non-sheet passing area.

7. The fixing device according to claim 5, further comprising a pressure roller disposed to catch the endless belt between any one of the plurality of winding members and the pressure roller, wherein the surface layer includes a passage area and the mark portion is formed on the passage area, the pressure roller includes a contact portion that contacts the passage area, and the contact portion is made of rubber.

8. The fixing device according to claim 5, further comprising a rotation detector disposed facing the surface layer, the rotation detector detecting a number of rotations of the endless belt, wherein the surface layer includes a passage area and the mark portion is formed on the passage area, the rotation detector includes a light emitting portion that emits light toward a part of the passage area, and a light receiving portion that receives light reflected off the part of the passage area, and the rotation detector detects changes in the light received by the light receiving portion to detect the number of rotations of the endless belt.

9. The fixing device according to claim 8, wherein a width of the mark portion in a rotational axis direction of the endless belt is equal to or more than a spot diameter of the light emitted from the light emitting portion and equal to or less than 20 mm, and a length of the mark portion in a circumferential direction of the endless belt is equal to or more than the spot diameter of the light emitted from the light emitting portion and equal to or less than a value obtained by dividing a circumferential length of the endless belt by twice a number of mark portions.

10. The fixing device according to claim 8, wherein the surface layer is provided with a plurality of the mark portions, and the plurality of mark portions are disposed at regular intervals in a circumferential direction of the endless belt.

11. An image forming apparatus comprising:

an image forming device that forms a toner image on a recording medium transported along a transport path; and a fixing device according to claim 6 that fixes the toner image onto the recording medium transported along the transport path.

12. A method of manufacturing an endless belt for an image forming apparatus, the method comprising:

preparing an endless belt including an endless base layer, an elastic layer provided on the base layer, and a surface layer provided on the elastic layer and containing fluororesin; and irradiating the surface layer with laser light having an ultraviolet-region wavelength to form at least one mark portion, wherein the laser light is pulsed, the laser light has a pulse interval equal to or more than a spot diameter of the laser light and equal to or less than twice the spot diameter of the laser light, and a surface of the mark portion is flat.

13. The method according to claim 12, wherein in the forming of at least one mark portion, the laser light has energy of 0.01 mJ or more and 0.2 mJ or less per pulse.

14. The method according to claim 12, wherein in the forming of at least one mark portion, the at least one mark portion is formed such that a difference in optical reflectance between a portion of the surface layer in which the at least one mark portion is not provided and the at least one mark portion is 20% or more.

15. The method according to claim 12, wherein in the forming of at least one mark portion, the at least one mark portion is formed to have a size of 25 $mm^2$ or more.

* * * * *